United States Patent [19]

Olmsted

[11] 4,284,522

[45] Aug. 18, 1981

[54] HIGH FIRE POINT DIELECTRIC INSULATING FLUID HAVING A FLAT MOLECULAR WEIGHT DISTRIBUTION CURVE

[75] Inventor: John H. Olmsted, New Berlin, Wis.

[73] Assignee: RTE Corporation, Waukesha, Wis.

[21] Appl. No.: 15,608

[22] Filed: Feb. 27, 1979

Related U.S. Application Data

[63] Continuation-in-part of Ser. No. 893,044, Apr. 3, 1978, abandoned.

[51] Int. Cl.[3] ..... H01B 3/22

[52] U.S. Cl. ..... 585/6.6; 208/14; 585/1; 585/7; 585/13; 585/955

[58] Field of Search ..... 252/63; 208/14; 174/17 LF, 25 C; 361/315; 585/7, 10, 13, 955, 1

[56] References Cited

U.S. PATENT DOCUMENTS

| | | | |
|---|---|---|---|
| 3,558,494 | 1/1971 | Gourlaoven et al. | 174/25 C X |
| 4,033,854 | 7/1977 | Oamori et al. | 252/63 X |
| 4,069,166 | 1/1978 | Masunaga et al. | 252/63 |
| 4,072,620 | 2/1978 | Masunaga et al. | 252/63 |
| 4,082,866 | 4/1978 | Link | 427/294 |

*Primary Examiner*—Harris A. Pitlick
*Attorney, Agent, or Firm*—Ronald E. Barry

[57] ABSTRACT

A liquid composition and method for forming the composition, the composition being intended for use in an oil-filled electrical apparatus to minimize the detrimental effects that can occur during high fault conditions which oil composition is biodegradable and formed from natural hydrocarbons and synthetic hydrocarbons which when combined form a flat pseudo-rectangular molecular weight distribution curve.

12 Claims, 4 Drawing Figures

HIGH FIRE POINT DIELECTRIC INSULATING FLUID HAVING A FLAT MOLECULAR WEIGHT DISTRIBUTION CURVE

RELATED APPLICATION

This application is a Continuation-In-Part of my earlier filed application, Ser. No. 893,044, filed Apr. 3, 1978, entitled "HIGH FIRE POINT DIELECTRIC INSULATING FLUID HAVING A FLAT MOLECULAR WEIGHT DISTRIBUTION CURVE. (now abandoned)"

BACKGROUND OF THE INVENTION

In the co-pending application of Edwin A. Link, Ser. No. 616,673 entitled "Method of Use and Electrical Equipment Utilizing Insulating Oil Consisting of a Saturated Hydrocarbon Oil", filed on Sept. 25, 1975, now U.S. Pat. No. 4,082,866 certain highly refined petroleum oil and mineral oils were disclosed which were considered sufficiently nonflammable to serve as insulating oil substitutes for polychlorinated byphenyls in electrical equipment. The essence of this invention was the avoidance of terminal olifenic bonds and significant advantages with respect to dealing with the problems associated with catastrophic failure in electrical apparatus. The insulating oil was additionally characterized as being of any average molecular weight between 500 and 700, having a fire point about 200° C., and remaining liquid down to near 0°.

Within those boundary conditions, it has been found that considerable differences exist in the usefulness of various oils considered for this purpose. The most obvious of these was the difference in pour point associated with the degree of dewaxing performed on the base fluids from which the oil was produced. Also the flash and fire points of a hydrocarbon dielectric oil can be increased by selectively distilling the lower molecular weight components from the oil.

Having discovered these differences in the various oils, it was decided to determine the aggregate effect on the physical and electrical properties obtained by blending the various oils. The unanticipated effects of blending on these properties was explained as being the result of filling the voids between molecules in the various liquid blends with other molecules in the blend. In other words, it is believed that the dissimilar molecules fit together into a more compact higher density structure which produced the unanticipated improvements in the physical and chemical properties of these blends.

SUMMARY OF THE INVENTION

This invention is related to the selective blending of natural and synthetic hydrocarbons of different molecular weights and molecular weight distributions in order to achieve a flat (essentially rectangular) molecular weight distribution curve of the final blend. The resulting improvements in the physical and chemical properties attributed to this process are improved fundamental electrical strength properties, increased arc recovery capabilities, and increased tolerance to residual high molecular weight waxes. This latter effect is particularly pronounced in the temperature region at and below the cloud point. Blending also improves the compatability of the oil with conventional insulating oils. This does not refer to chemical compatibility, but rather to physical mixing processes where the two materials are intentionally or inadvertently mixed. This is a direct result of the increase in specific gravity of the blend, bringing it into close proximity to that associated with conventional transformer oil.

DESCRIPTION OF THE INVENTION

Figure 1:
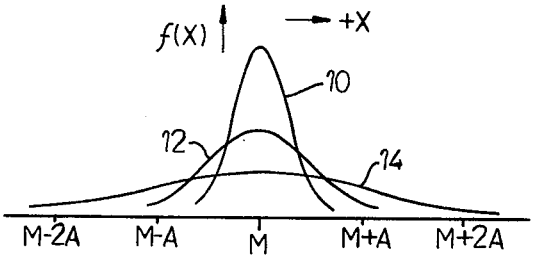
FIG. 1 is a comparative graph showing a number of normal distribution or Gauss distribution curves having the same or common mean average population density.

Referring to FIG. 1 of the drawing a number of Gauss distribution curves 10, 12 and 14 are shown. These curves are shown in "Advanced Engineering Mathematics", by Erwin Kreyszig, 3d Edition, John Wiley and Sons, Inc. 1972, the curves are based on the probability that the normal distribution of random variables will vary from the mean average, a standard deviation. As seen in FIG. 1, curve 10 has a mean average value M for a quantity A of random variables. The curve is formed by assuming a standard deviation, sigma(s) equal to 0.25, the curve 10 thus having a narrow base and a high peak.

Curve 12 has the same mean average value M and the same quantity A of random variables as curve 10, however, the standard deviation sigma(s) now equals 0.5, the curve 12 thus producing a Gauss distribution curve having a wider base and a lower peak.

Curve 14 also has the same mean average value M and the same quantity A of random variables as curves 10 and 12, however, the standard deviation sigma is now equal to 1 thus producing a Gauss distribution curve having a wide base and a low peak.

Figure 2:
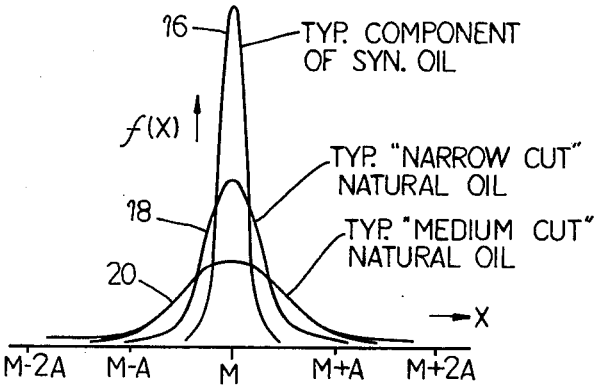
FIG. 2 is a comparative graph of typical cuts of synthetic and natural hydrocarbon oils each having the same mean average molecular weight.

Referring to FIG. 2 a comparative graph is shown of a molecular weight distribution curve 16 for a typical component of a synthetic oil, a molecular weight distribution curve 18 for a typical "narrow cut" natural oil and a molecular weight distribution curve 20 for a typical "medium cut" natural oil. These curves were formed by conventional chromatographic techniques which confirmed my belief that the deviation of molecular weight density of hydrocarbon oils followed a standard deviation. The distribution curves thus followed the pattern of the normal distribution or Gauss distribution curves 10, 12 and 14.

In this regard, it should be noted that each of the oils in this graph has the same average molecular weight M and that each has the same quantity A of material. As seen in the graph the distribution curve 16 for the component of synthetic oil has a high peak and a small base. Synthetic oils generally display a number of sharp peaks which are repeated at multiples of the original raw material stock. The number of peaks displayed and the relative values are quite arbitrary in that they are under the control of the particular process being utilized.

In the typical narrow cut natural oil as seen in curve 18, the peak is lower than the synthetic oil but the base is wider which is characteristic of Gauss distribution curves. This is also true of the medium cut natural oil shown in curve 20 which has a low peak and a very wide base.

Figure 3:
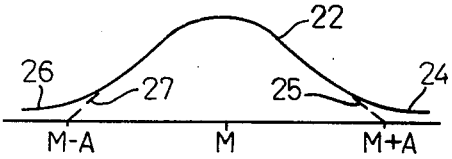
FIG. 3 is a graph of a single molecular weight distribution curve for a hydrocarbon oil showing in dotted line the high and low molecular weight ends of the curve shortened to bring the curve within certain molecular weight boundary conditions.

Referring to FIG. 3, a typical medium cut natural oil distribution curve 22 is shown having a long tail at both the high and low molecular weight ends of the curve. The tail 24 at the high molecular weight end which leads to high pour points associated with such products, is generally dewaxed by solvent extraction at light temperatures using propane or other hydrocarbon solvents, this results in a molecular weight distribution curve with a shortened tail, as shown dotted at the high molecular weight end. The tail 26 at the low molecular weight end of the curve 22 can also be shortened as shown dotted at 27 by distillation. These are standard techniques which as described hereinafter can be used to bring the molecular weight distribution curve within predetermined molecular weight boundaries.

Figure 4:
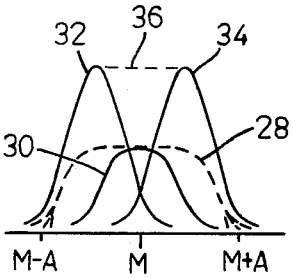
FIG. 4 is a graph showing molecular weight distribution curves for three hydrocarbon oils which have been combined to form a pseudo-rectangular distribution curve according to the invention.

Referring to FIG. 4, a pseudo-rectangular Gauss distribution curve 28 is shown dotted on the graph. The pseudo-rectangular curve contemplates a liquid composition having an even molecular weight population density within the boundary limits M−A and M+A. In order to achieve the pseudo-rectangular curve, a number of hydrocarbon oils are blended such that the molecular weight density for the combined oils will be substantially equal within those boundary limits. This result can be achieved by using the chromotographic technique to establish the normal distribution curve for any number of candidate synthetic and natural hydrocarbon oils. A hydrocarbon oil is then selected from the candidate oil which has a molecular weight distribution curve 30 that will fill the major portion of the desired pseudo-rectangular curve 28.

A second oil is then selected, having a molecular weight distribution curve 32 and a mean average molecular weight less than the mean average molecular weight of distribution curve 30, to fill the remaining portion of the low molecular weight portion of the pseudo-rectangular curve 28. It should be noted that the curve 32 for the second oil extends above the pseudo-rectangular curve 28. This curve will be brought within the desired curve 28 after normalizing the blend as described hereinafter. If the curve 28 is not filled by the two oils, a third oil is then selected having a molecular weight distribution curve 34 and a mean average molecular weight greater than the mean average molecular weight of curve 30. The curve 34 for this oil also extends above the curve 28 and will also be brought within the curve 28 by normalizing the blend.

When combined the molecular weight population densities in the overlapped areas of the curves will then fill the space between the peaks of the two oils represented by the distribution curves 32 and 34. This can be better understood when it is realized that the peaks of the molecular weight distribution curves represents the largest number of molecules of that weight in the oil. The number of molecules of greater or less weight dropping off at the standard deviation rate for that curve. The number of molecules in the overlapped areas of the curves are doubled and when added to the molecules present substantially fill the area between the peaks of the curves 32 and 34. The dotted line 36 indicating a substantially flat boundary between the peaks of the oil 32 and 34. The blend is then normalized by reducing the quantity of the combined oils to the quantity represented by the area within the pseudo-rectangular distribution curve 28.

As an example, if the curve 28 represents one gallon of oil in the molecular weight range of 500–700, then the blend of the three oils represented by curves 30, 32 and 34 are normalized to a common quantity such as one gallon. Assuming that the curve 30 represents a half of a gallon of oil and the curves 32 and 34 each represent three quarters of a gallon of oil, the total blended oil would be two gallons. Normalizing this blend to one gallon would then require a quarter of a gallon of oil represented by the curve 30 and three-eighths of a gallon of oil represented by each of the curves 32 and 34. If the tails at the high and low molecular weight ends of the blended oil extend beyond the required molecular weight boundaries of the pseudo-rectangular distribution curve 28, then they can be shortened by the methods described above.

The following examples are representative of the blends of hydrocarbon oils that can be combined to provide the desired pseudo-rectangular shape molecular weight distribution curve.

Blend A is prepared by processing the following materials in the given volumetric ratios:

160 parts Type 1844 electrical base oil produced by Exxon Corporation. This material is produced by hydrorefining of paraffinic stock and has a mean molecular weight of approximately 570. It has a pour point of 10° to 15° F. and a cloud point of 20° to 22° F. (indicating the presence of a high molecular weight paraffins).

15 parts Type EXK-301 white oil produced by Pennreco Corporation. This material is a more highly refined aliphatic hydrocarbon produced from Pennsylvania grade crude stock. It has a similar molecular weight distribution to that of the Exxon 1844 base oil with a mean molecular weight of approximately 420. In addition to the normal refining, it has been filtered and processed through Fullers Earth to reduce the concentration of color centers and polar contaminents.

4 parts Type PAO-20E synthetic while oil produced by Uniroyal Chemical Corporation. This material is an available fully-saturated aliphatic synthetic hydrocarbon produced by the controlled polimerization of octene followed by hydrogenation to complete the saturation process. Its predominent carbon members are 32, 40, 48 and 56. The average molecular weight of this material is approximately 620.

This blend is produced by physically mixing of the three components followed by exposure to vacuum at a temperature between 200° an 220° F. The mixing and temperature vacuum exposure time are dependent upon the quantities and surface areas of the blends being prepared.

Blend B is prepared by processing the following materials in a given volumetric ratios:

30 parts L-1811 heat transfer oil produced by ARCO (Atlantic Richfield Corporation). This material is produced from paraffinic crude by deep hydro-refining, processing by contact with Fullers Earth, and conventional filtration to produce a saturated white oil of food grade quality. It has a mean molecular weight of approximately 720 with a maximum detectable molecular weight component of 900. This is the same aliphatic hydrocarbon oil described in the Link application 616,673.

10 parts HPC-202 (H-22) synthetic white oil produced by the Hanover Processing Company. This material is constructed in a manner which is technically similar to that used to produce the Uniroyal PAO-20E, however, a mixed feedstock is used. Further, the end point control is not so precise. These differences result in a molecular weight distribution which is not as limited or as discrete for its oil as for the Uniroyal material. The mean molecular weight of this material is approximately 395. A typical carbon number is from 20 to 60.

3 parts PAO-20E saturated synthetic aliphatic hydrocarbon produced by the Uniroyal Chemical Division of Uniroyal, Inc. This material is the same as the PAO-20E material described in Blend A.

This blend is produced by physically mixing the above three components followed by exposure to vacuum at a temperature between 100° and 200° F. The mixing and temperature vacuum time are dependent upon the quantities and surface areas of the blends being prepared.

Blend C can be produced by performing the following processing sequence on Exxon 1844 electrical base oil. The Exxon 1844 material is the same as the material described above. The process involves the following:

1. Separate into five groups, by molecular weight, using high-reflux distillation:
   a. above 700,
   b. 650–700
   c. 550–650
   d. 500–550
   e. below 500.
2. Combine half of group c with all of groups b and d and dispose of groups a and e.
3. Process the resulting fluid by contact with Fullers Earth (using 5% Fullers Earth by weight) at a temperature of 180° to 200° F.
4. Expose to high vacuum at 210° to 220° F.

All three of these blends, A, B and C, have been found to have molecular weight distribution curves of the desired pseudo-rectangular shape within the prescribed boundary conditions. The conditions being defined as a substantially equal molecular weight density in the molecular weight range of 500 to 700, a fire point 200° C. and remaining liquid down to 0° C.

The embodiments of the invention in which an exclusive property or privilege is claimed are defined as follows:

1. A method for producing a blend of oil having a substantially equal molecular weight density within predetermined molecular weight boundaries, said method comprising the steps of establishing for a predetermined quantity of blended oil a pseudo-rectangular molecular weight distribution curve having predetermined molecular weight limits, determining the molecular weight distribution curves for equal quantities of a number of candidate natural and synthetic hydrocarbon oils, selecting from the distribution curves for the candidate oils a first curve that fills a portion of the established pseudo-rectangular distribution curve, selecting from the remaining distribution curves for the candidate oils those curves which when combined with the selected first curve and with each other fill the remaining portion of the pseudo-rectangular curve and blending the quantities of oils represented by the selected curves.

2. The method of claim 1 including the step of normalizing the quantities of the oils represented by the selected distribution curves to the predetermined quantity represented by the pseudo-rectangular curve.

3. The method of claim 1 or 2 including the step of shortening the high or low molecular weight ends of the distribution curve for the blended oils to substantially conform the curve of the blended oils to the curve of the pseudo-rectangular distribution curve.

4. The method of producing a blend of oil intended for use in an oil filled electrical apparatus, the blend of oil having a substantially equal molecular weight density within predetermined molecular weight limits, said method comprising the steps of establishing a pseudo-rectangular molecular weight distribution curve having molecular weight limits of 500–700, determining the molecular weight distribution curves for equal quantities of a number of candidate synthetic and natural hydrocarbon oils, selecting from the distribution curves for the candidate oils a first curve that fills a portion of the established pseudo-rectangular distribution curve, selecting from the remaining distribution curves for the candidate oils those curves which when combined with the selected first curve and with each other fills the remaining portion of the pseudo-rectangular curve, normalizing the selected distribution curves to the predetermined quantity and blending the selected hydrocarbon oils represented by the selected distribution curves to form the liquid blend.

5. The method according to claim 4 including the step of shortening the high molecular weight end of the distribution curve for the blended oils by solvent extraction to substantially conform the curve of the blended oils to the curve of the pseudo-rectangular distribution curve at the high molecular weight end.

6. The method of claim 4 including the step of shortening the low molecular weight end of the distribution curve for the blended oil.

7. A liquid blend intended for use in an oil-filled electrical apparatus to minimize the detrimental effects that can occur during high fault conditions which oil composition is a biodegradable and environmentally safe oil and consists essentially of a blend of oils including a natural saturated hydrocarbon oil and a synthetic saturated aliphatic hydrocarbon oil, said blend having a substantially equal molecular weight density in the range molecular weight range of about 500 to about 700, a fire point above 200° C. and a pour point near 0° C.

8. The blend according to claim 7 wherein said blend includes two natural hydrocarbon oils having a mean molecular weight of approximately 570 and a mean molecular weight of approximately 420 and the synthetic hydrocarbon oil has an average molecular weight of 620.

9. A liquid blend intended for use in an oil-filled electrical apparatus to minimize the detrimental effects that can occur during high fault conditions which fluid consists essentially of a blend of oils including one natural saturated hydrocarbon oil and two synthetic saturated aliphatic hydrocarbon oils, said oils being selected to provide a substantially equal molecular weight density in the molecular weight range of 500 to 700.

10. The liquid blend according to claim 9 wherein said blend has a pseudo-rectangular molecular weight distribution curve.

11. The liquid blend according to claim 10 wherein said blend has a fire point above 200° C. and a pour point near 0° C.

12. A liquid blend intended for use in an oil-filled apparatus, said fluid consisting essentially of a natural hydrocarbon oil of different molecular weight groups having different molecular weight distributions, said groups being selected to provide a substantially flat molecular weight distribution curve having a predetermined molecular weight range from 500 to 700 whereby a pseudo-rectangular shaped molecular weight curve is produced.

* * * * *